US006886294B1

(12) United States Patent
Carey

(10) Patent No.: US 6,886,294 B1
(45) Date of Patent: May 3, 2005

(54) STORM RESISTANT FIXED SHUTTER ASSEMBLY

(76) Inventor: Michael Carey, 3605 Oakwood Ct., Panama City Beach, FL (US) 32408

( * ) Notice: Subject to any disclaimer, the term of this patent is extended or adjusted under 35 U.S.C. 154(b) by 0 days.

(21) Appl. No.: 10/429,346

(22) Filed: May 6, 2003

(51) Int. Cl.[7] ..... E06B 3/32; E06B 7/08
(52) U.S. Cl. ..... 49/73.1; 49/74.1
(58) Field of Search ..... 49/73.1, 74.1, 49/77.1, 80.1, 82.1, 86.1, 403, 87.1, 92.1; 52/473; 454/31, 277, 278, 279, 281, 313

(56) References Cited

U.S. PATENT DOCUMENTS 2,185,712 A * 1/1940 Rowley ..... 49/82.1
2,742,681 A * 4/1956 Goodwyn ..... 49/77.1
3,196,895 A * 7/1965 Dayus ..... 137/270
4,485,841 A * 12/1984 Hixenbaugh ..... 49/74.1
4,967,509 A * 11/1990 Storey et al. ..... 49/74.1
5,778,598 A * 7/1998 Ohanesian ..... 49/74.1
6,675,534 B2 * 1/2004 Marocco ..... 49/86.1

* cited by examiner

*Primary Examiner*—Hugh B. Thompson, II
(74) *Attorney, Agent, or Firm*—William B. Noll

(57) ABSTRACT

A Bahama or Colonial-type shutter assembly for external openings of a structure, where the shutter assembly is resistant to damage by flying debris from high wind storms and hurricanes. The shutter assembly comprises a generally rectangular frame fabricated of a light-weight metal, such as aluminum, having a pair of side members, and top and bottom members. Extending between and into the side members are a plurality of angled slats, where the ends of the angled slats are anchored within the side members by a pair of rod members passing through apertures in proximity to the slat ends. A locking mechanism may be provided to secure a pair of shutter assemblies during the periods of high winds and hurricanes.

16 Claims, 3 Drawing Sheets

STORM RESISTANT FIXED SHUTTER ASSEMBLY

FIELD OF THE INVENTION

This invention is directed to the field of storm resistant shutters of the type to provide protection to windows from flying debris resulting from severe storms and hurricanes.

BACKGROUND OF THE INVENTION

The present invention relates to a shutter assembly having the appearance of a conventional external shutter or awning, but offering security and protection to a homewowner, for example, against flying objects that may be generated through high winds of the kind associated with hurricanes. Southern states, especially Florida, are particularly vulnerable to hurricanes. Historically, during the hurricane season, i.e. June to October, these southern slates may be subjected to from six to twelve named hurricanes, and damage from the hurricanes can run into millions of dollars. Traditional construction practices do not provide the security and protection to homeowners that can lower the costs associated with stone damage.

Conventional awnings, or shutters, typically have a perimeter framework with a plurality of horizontal louvers or slats. The louvers include openings between individual louver slats to allow air and sunlight to enter the structure to which the awning is attached, and to permit persons within the structure to see out. The frame can be attached at the top by a hinge to the top, or side, of a window or other opening. The protective awning or shutter is presized in length and width to cover the entire window or other opening. In the case of an awning, the awning can be rotated about the hinge, with the lower portion of the awning moving in an arc relative to the hinge, and away from the lower portion of the window. The awning can thus be positioned at some desired angle relative to the window. The lower portion of the awning can be held away from the window by one or a pair of support arms. The arms can be removable and/or include a release mechanism to permit the lower portion of the awning to be moved toward the window to a closed position substantially parallel to the window to provide security or storm protection.

However, because the awning or shutter louvers have openings between the louver slats to allow air and sunlight to enter the structure, the protection provided is limited by the strength of the individual horizontal louver slats. Individual louver slats having an opening between adjacent slats cannot provide sufficient protection against large magnitude storms such as hurricanes.

Subsequent to hurricane Andrew hitting South Florida in August of 1992, several Florida counties have begun to require minimum building code standards for storm shutters. For example, in the Miami Fla. area, Dade County standards require the shutter to withstand certain tests including a large missile impact test consisting of a length of 2"×4" wood weighing about 9 pounds shot from an air cannon at approximately 34 miles per hour directly into the shutter. Conventional Bahama awnings, or shutters, having openings between adjacent slats fail to pass these tests. Recognizing the need to provide protection, especially to meet this severe impact test, the prior art has developed a number of systems to meet the challenge, where the prior art is reflected in the following U.S. patents:

U.S. Pat. No. 4,688,351, to Torres, teaches a conventional frame for a jalousie type window that is made secure against passage therethrough by individuals by the insertion of bars through the openings in the side frame members normally utilized by the jalousie support brackets which are then pivoted on the bars. The ends of the bars, where they project through the side frames members of the jalousie frame, are rigidly connected, such as by welding to a respective one of a pair of bars parallel to the outer side of the side frame members. The bar ends extend beyond the second bars for embedment in a masonry surrounding a window opening adapted to receive the frame. The brackets and jalousie slats are controlled in a conventional manner.

U.S. Pat. No. 4,967,509, to Storey et al., discloses a high security grating which resembles a conventional wooden window shutter. The shutter uses crossbars which extend across a door or window into a shutter frame. A tie rod extends through bores in the crossbar ends to tie the crossbars together and hold them in place. A metal frame covers the tie rods and shutter blades cover the crossbars. The shutter blades can be pivoted using an operator rod. The shutters are mounted inside a building using heavy duty hinges and deadbolts which allow them to be alternatively closed over a door or window or folded away to the side.

U.S. Pat. No. 5,490,353, to McLaughlin, relates to an elegant plantation security shutter assembly for a window in a wall of a building that consists of a casing with components for reinforcing the casing. Structures are for mounting the casing onto the wall behind the window. A pair of shutters are provided, with elements for reinforcing each shutter. Paraphermalia is provided for securing each shutter within the casing, so as to stop a thief from an unauthorized entry through the window into the building, by preventing the thief from breaking the shutters and the casing.

U.S. Pat. No. 6,543,188, to Poma et al., is directed to an awning that permits light and air to enter the structure to which the awning is attached, that can be utilized to protect against major storms, and that can pass strict building code standards testing. The awning includes a perimeter framework that is adapted to receive a removable rigid support plate. In an second embodiment, the invention, thereof provides a shutter that is inexpensive, easy and quick to manufacture, that can provide protection against major storms, and that can pass strict building code standards testing. The shutter includes modular louver sections that have an integral rigid backing plate.

While the foregoing prior art recognize the need for security and protection to structures, especially single family dwellings, in the high risk areas of southern United States, the proposed solutions set forth complex and costly systems. In contrast, the present invention offers a secure and safe storm resistant shutter assembly that is compatible with traditional house construction styles. The manner by which the present invention achieves the goals hereof will become clearer in the description which follows, particularly when read in conjunction with the accompanying drawings.

SUMMARY OF THE INVENTION

This invention is directed to an effective storm resistant shutter assembly designed and constructed to meet or exceed building standards in areas prone to high winds and hurricanes, where serious damage can result from flying debris. The shutter assembly comprises a peripheral frame, not unlike in appearance to standard external wood shutters, having a pair of hollow, channel-like side members, and comparably shaped top and bottom members, where said members are fabricated of a light-weight metal, such as aluminum. Extending between and into the respective side members are plural, spaced apart, fixed, angled slats. The respective corners of the top and bottom members are internally provided with support members for slidably receiving a pair of metal rods, one each extending vertically within a side member, where in proximity to the ends of the slats apertures are provided to further receive said metal rods. By this arrangement, the respective slats are securely anchored within the shutter assembly.

Accordingly, a feature of this invention is the provision of a secure and protective shutter assembly that in appearance resembles a conventional exterior wooden shutter, thereby allowing for construction upgrades to traditional single family dwellings.

Another feature hereof is a preferred shutter construction designed to meet and exceed severe building codes in areas where high winds and hurricanes are yearly threats to such areas.

Still a further feature of the invention is a shutter assembly that includes plural, angled slats, preferably fabricated of aluminum, securely anchored within the metal peripheral frame thereof.

These and other features of this invention will become more apparent from the following specification and accompanying drawings.

DETAILED DESCRIPTION OF PREFERRED EMBODIMENT

Figure 1:
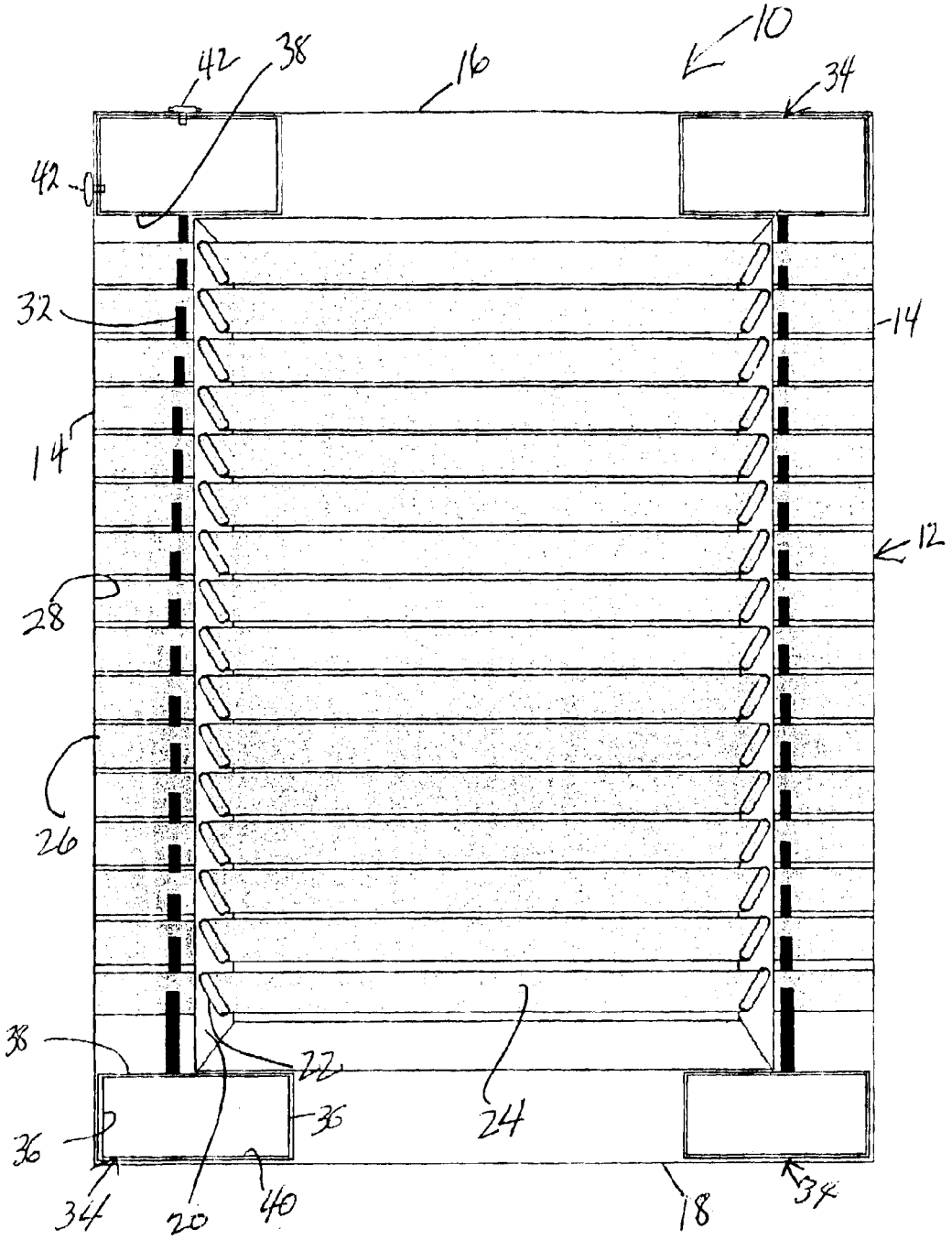
FIG. 1 is a plan view, partially in perspective and in section, with parts removed, to reveal certain details of the storm resistant shutter assembly according to this invention. While the horizontal slats of the assembly are shown discontinuous, to illustrate details and shape of the construction, in reality the slats are continuous as more fully explained in the detailed description below.

This invention teaches a storm resistant, fixed shutter assembly that meets or exceeds severe building codes in hurricane prone areas, such as the southeastern and Gulf coast states of the United States. Specifically, the assembly hereof meets the new Florida building code (2001) for a missile impact test, a test that came into existence after the departure of Hurricane Andrew in South Florida in 1992, where efforts are afoot to extend the test to other coastal areas subject to hurricanes and high wind storms. The manner by which the shutter assembly of this invention meets or exceeds stringent building codes for the protection of external openings of a structure, such as dorrs and windows, in South Florida, for instance, will become apparent in the following description and drawings, where like reference numerals in the drawings represent like components or features throughout the several views.

Turning now to the several Figures, FIG. 1 illustrates a plan view of a preferred shutter assembly 10 according to the invention, where the illustrated shutter assembly, fabricated of a light-weight metal, such as aluminum, is designed to simulate a Colonial-type shutter, as known in the art, to be compatible with conventional construction styles. The shutter assembly 10 comprises a peripheral frame 12 consisting of a pair of channel side members 14, generally rectangular in cross-section, top and bottom channel members 16, 18 respectively, where the respective members are welded or otherwise secured together, such as a miter joint, i.e. 45°, in the generally rigid rectangular shape as shown in FIG. 1.

Figure 2:
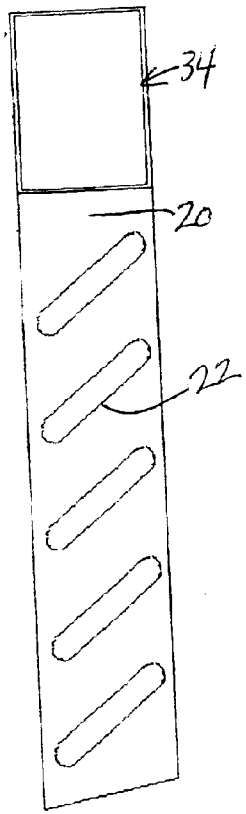
FIG. 2 is an enlarged, partial front view of of the inside face of a side frame member showing plural milled, angled slots, with each slot for sliding engagement with a corresponding slat.
Figure 3:
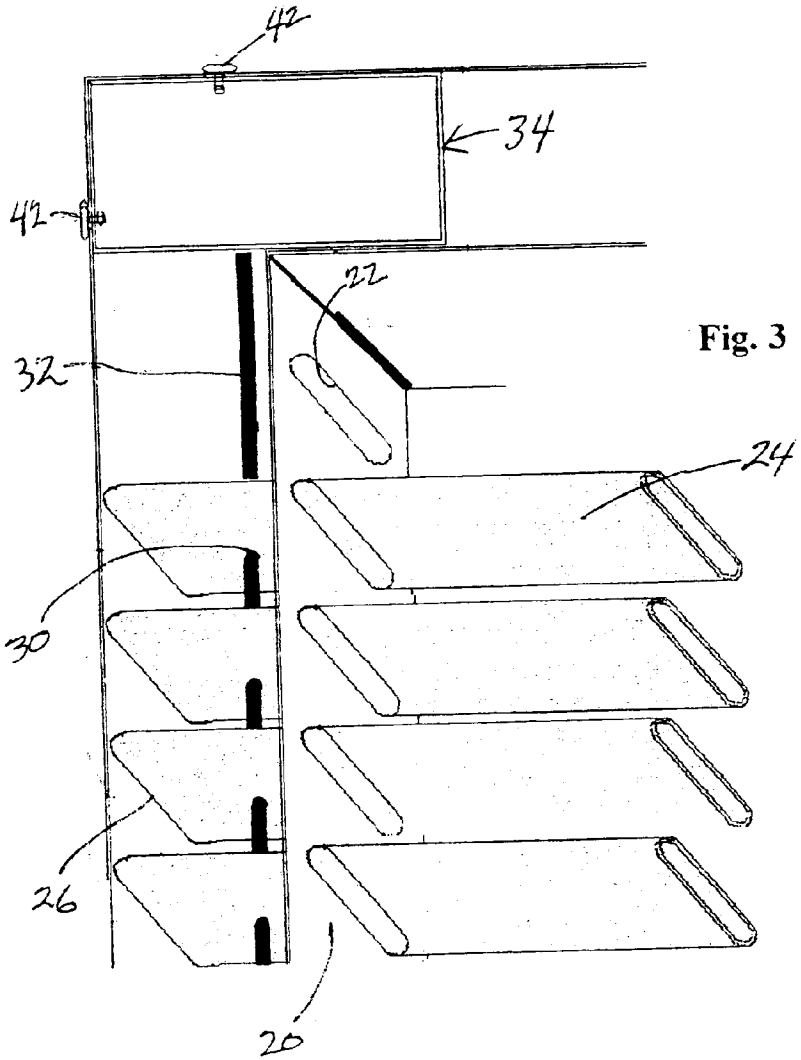
FIG. 3 is an enlarged, partial perspective view of the inside face of the side frame member of FIG. 2, also showing a plurality of hollow blade slats.

As best seen in FIGS. 2 and 3, the inside faces 20 of the side members 14 are provided with a plurality of angled slots 22, where a preferred manner of preparing the slots is by a precise laser machining technique. Insertable through said slots 22 are a like plurality of slats 24 or blades, where the slats 24 are preferably hollow blades having a typical size of ⅜"×2"×0.062". The slats 24 are of a length to extend between and into said channel side members 14, where the respective ends 26 abut the inside walls 28 of said channel side members 14. In proximity to the slat ends 26, the angled slats include aligned oval shaped apertures 30 for slidably receiving an anchoring support rod 32, where a typical rod is aluminum of about ⅜". By this arrangement, the structure is highly resistant to penetration by flying debris as defined by the State of Florida building codes for hurricane prone areas.

Optionally, for added strength, the respective corners of the peripheral frame 12 may be provided with a corner support 34, such as extruded aluminum, where typical dimensions may be 1¾"×"×⅛". Note in FIG. 1 that the corner support 34, consisting a pair of side walls 36, an inner wall 38 and an outer wall 40, with the anchoring support rod 32 extending between a pair of said corner supports 34. The respective corner supports 34 are fixed within the peripheral frame by fasteners 42, such its rivets, extending through the outer wall thereof through a respective outer wall 40 and outer side wall 36.

Figure 5:
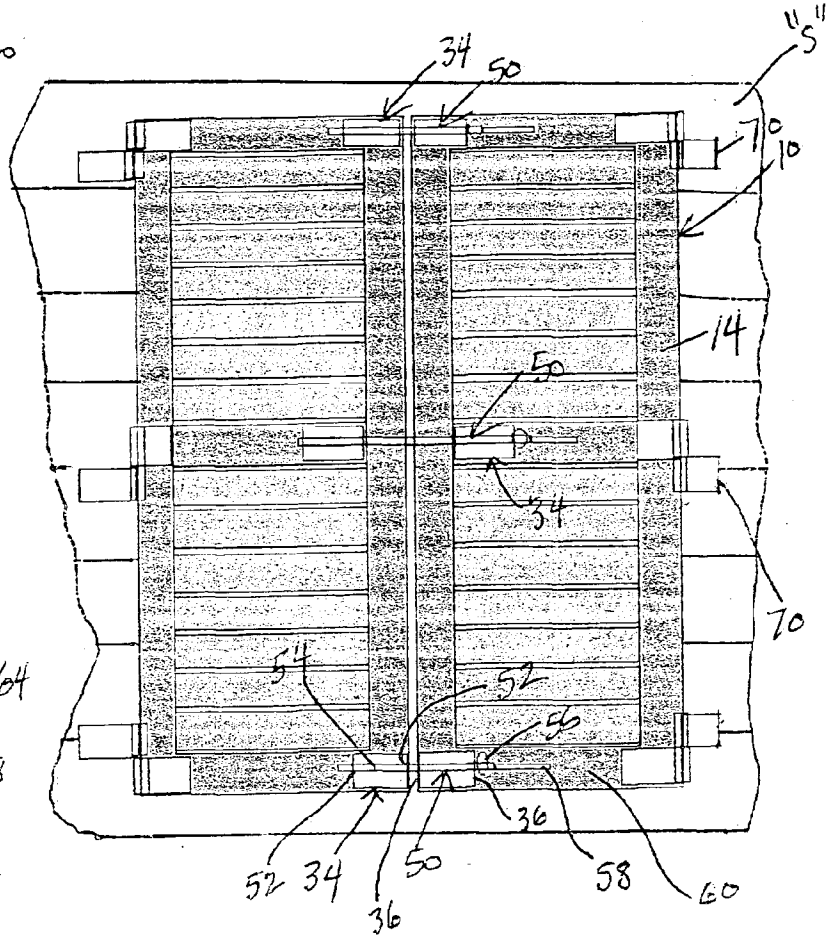
FIG. 5 is a front view, similar to FIG. 4, showing the preferred locking mechanism for a Colonial-type shutter assembly of the invention, where parts have been removed to reveal internal details.
Figure 4:
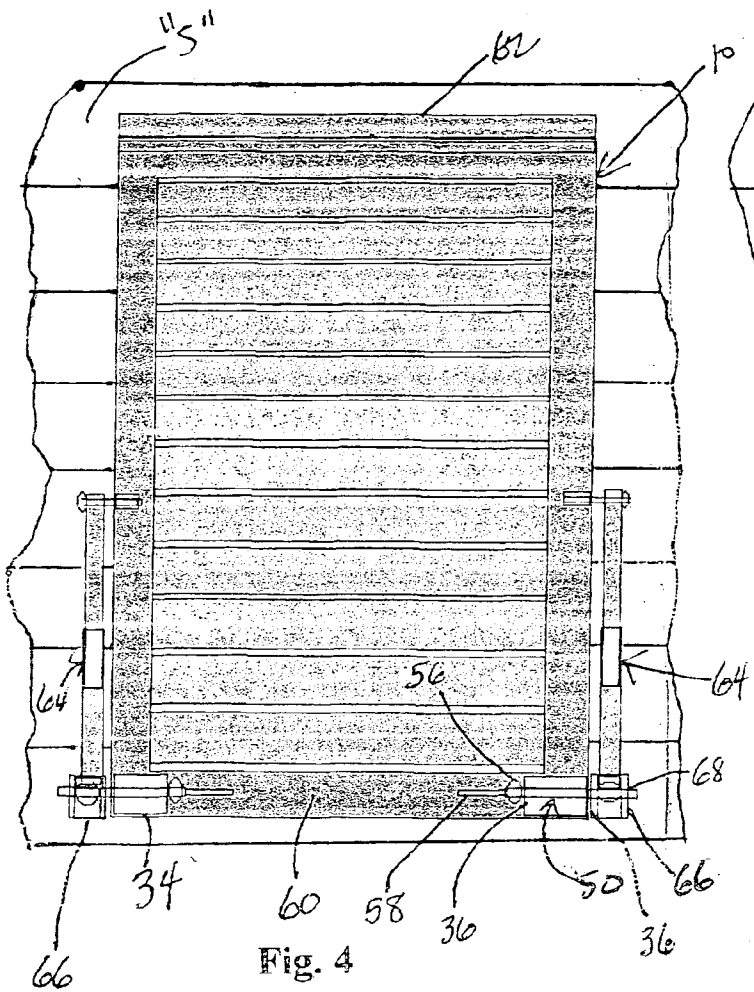
FIG. 4 is a front view of a preferred locking mechanism for a Bahama-type shutter assembly according to the invention, showing the locking mechanism to secure the shutter assembly in anticipation of a heavy storm or hurricane, where parts have been removed to reveal internal details.

FIGS. 4 and 5 illustrate preferred locking mechanisms, such as for a Bahama-type shutter assembly (FIG. 4), which is vertically hinged, and a Colonial-type shutter assembly (FIG. 5), which is horizontally pivotal. In anticipation of a heavy storm or hurricane, it is important that the shutter assembly 10 be closed over the structure's external opening to be protected, and then secured until it is safe to reopen. This locking mechanism 50 works in combination with the corner supports 34. Specifically, the side walls 36 thereof are provided a pair of aligned openings 52 for slidably receiving a locking rod 54 having a knob 56 mounted thereon and slidable along a slot 58 in the face 60 of the channel member 18.

Turning specifically to FIG. 1, the vertically hinged shutter assembly is hinged 62 to the structure "S", and includes a pair of telescopic, pivotal arms 64, as known in the art. The respective arms 64 terminate at their free ends by fixed housings 66 having complementary aligned openings 68 for sliding engagement with the locking rod 54. With the shutter assembly against the structure, the locking rod 54 is moved laterally from an inner-most position to an outer-most position, the fully locked position illustrated in FIG. 4.

FIG. 5, a Colonial-type shutter assembly, shows three exemplary locking mechanisms 50. Depending on the size of the shutter assembly 10, one or a plurality of the locking mechanisms 50 be used, one for the top and bottom, and a midpoint locking mechanism. In each case, as with the locking mechanism in FIG. 4, the locking mechanism works in combination with a pair of internal support members 34. Finally, as known in the art, the channel side members 14 may include hinges 70 secured by fasteners, not shown, to the wall of the structure "S". While the respective locking mechanisms are shown in the locked and secured position, merely sliding the knob 56 and locking rod 54 will free the shutter assembly 10 to allow opening same after the danger has passed.

It is recognized that changes, variations and modifications may be made to the shutter assembly, particularly by those skilled in the art, without departing from the spirit and scope of the invention. Accordingly, no limitation is intended to be imposed thereon except as set forth in the accompanying claims.

I claim:

1. A storm resistant shutter assembly for providing protection to external openings of a structure, said assembly comprising:

a) a generally rigid, metal frame comprising a pair of vertically oriented channel side members, a top channel member, and a bottom channel member, where said members are secured together into a rectangular shape;

b) each said channel member featuring an inside face having a plurality of spaced apart, angled through slots angled to said vertical orientation;

c) a like plurality of metal slat blades extending between and through said slots into said channel-like side members, where said slat blades within said channel side members include aligned apertures;

d) a pair of metal rods, within each respective channel side member, extending vertically through said aligned apertures within said channel-like members; and, e) a generally rectangular corner support within said frame and secured thereto by fastening member.

2. The storm resistant shutter assembly according to claim 1, wherein said channel members, slat blades and said metal rods are fabricated of aluminum.

3. The storm resistant shutter assembly according to claim 2, wherein said blade slats are hollow.

4. The storm resistant shutter assembly according to claim 1, wherein said corner supports consist of a pair of side walls, an inner wall and outer wall, where there are at least two fasteners extending through said channel member, and a corresponding said top or bottom channel member into a contiguous said wall of said corner support.

5. The storm resistant shutter assembly according to claim 1, wherein said channel side members are defined in part by spaced apart parallel walls, and said slat blades extend through a first said parallel wall into contact with said second parallel wall.

6. The storm resistant shutter assembly according to claim 1, including hinge means for mounting said shutter assembly to a structure and to allow movement of said shutter assembly from a first position to a second position, further including a locking mechanism for securing same in one of said positions.

7. The storm resistant shutter assembly according to claim 6, wherein said locking mechanism operates in combination with a said corner support, said locking mechanism including a slidable rod for sliding engagement with said corner support.

8. The storm resistant shutter assembly according to claim 7, wherein said slidable rod is contained within a said channel member and includes a manually operable knob externally accessible to effect sliding movement of said slidable rod.

9. In combination with a structure having at least one external opening to be protected against high winds and hurricanes, where protection is provided by a hinged shutter assembly, the improvement comprising a storm resistant shutter assembly comprising:

a) a generally rigid, metal frame comprising a pair of vertically oriented channel side members, a top channel member, and a bottom channel member, where said members are secured together into a rectangular shape;

b) each said channel member featuring an inside face having a plurality of spaced apart, angled through slots angled to said vertical orientation;

c) a like plurality of metal slat blades extending between and through said slots into said channel-like side members, where said slat blades within said channel side members include aligned apertures;

d) a pair of metal rods, one on each side, extending vertically through said aligned apertures within said channel members; and, e) a generally rectangular corner support within said frame and secured thereto by fastening members.

10. The combination according to claim 9, wherein said channel members, slat blades and said metal rods are fabricated of aluminum.

11. The combination according to claim 9, wherein said corner supports consist of a pair of side walls, an inner wall and outer wall, where there are at least two fasteners extending through said channel member, and a corresponding said top or bottom channel member into a contiguous said wall of said corner support.

12. The combination according to claim 10, wherein said blade slats are hollow.

13. The combination according to claim 9, wherein said channel side members are defined in part by spaced apart parallel walls, and said slat blades extends through a first said parallel wall into contact with said second parallel wall.

14. The combination according to claim 9, including hinge means for mounting said shutter assembly to said structure and to allow movement of said shutter assembly from a first position to a second position, further including a locking mechanism for securing same in one of said positions.

15. The combination according to claim 14, wherein said locking mechanism operates in combination with a said corner support, said locking mechanism including a slidable rod for sliding engagement with said corner support.

16. The combination according to claim 15, wherein said slidable rod is contained within a said channel member and includes a manually operable knob externally accessible to effect sliding movement of said slidable rod.

* * * * *